US005974935A

United States Patent [19]

Willis et al.

[11] Patent Number: 5,974,935

[45] Date of Patent: Nov. 2, 1999

[54] BELT SPLITTING MACHINE

[75] Inventors: John A. Willis; Adrian J. Willis, both of Raleigh; George H. Stoner, III, Wilson; William J. Hayes, Jr., Raleigh, all of N.C.

[73] Assignee: Belt Equipment, Inc., Zebulon, N.C.

[21] Appl. No.: 09/105,682

[22] Filed: Jun. 26, 1998

[51] Int. Cl.[6] ..... B26D 3/06

[52] U.S. Cl. ..... 83/870; 83/425; 30/293

[58] Field of Search ..... 83/397, 397.1, 83/396, 398, 425, 425.4, 435.13, 435.16, 435.17, 435.22, 437.1, 437.2, 870, 874, 206, 393; 30/293, 294, 290

[56] References Cited

U.S. PATENT DOCUMENTS

| | | | |
|---|---|---|---|
| 527,963 | 10/1894 | Gay | 83/425 |
| 916,993 | 4/1909 | Callaghan | 30/293 |
| 961,643 | 6/1910 | Pierce | 30/293 |
| 1,307,290 | 6/1919 | Yahres | 30/293 |
| 2,413,544 | 12/1946 | Carpenter | 30/293 |
| 2,711,020 | 6/1955 | Hastings | 83/435.17 |
| 2,902,091 | 9/1959 | Dahle | 83/425 |
| 3,109,339 | 11/1963 | Braun et al. | 83/425 |
| 3,110,104 | 11/1963 | Wicki et al. | 30/293 |
| 3,286,351 | 11/1966 | McAlister | 30/293 |
| 3,730,031 | 5/1973 | Huttemann | 83/425 |
| 3,831,279 | 8/1974 | Burns | 30/293 |
| 3,877,119 | 4/1975 | Gierse et al. | 83/425 |
| 4,315,450 | 2/1982 | Pray . | |
| 4,414,874 | 11/1983 | Barnes et al. . | |
| 4,741,235 | 5/1988 | Price . | |
| 4,838,137 | 6/1989 | Azuma . | |
| 5,001,958 | 3/1991 | Hall . | |
| 5,119,648 | 6/1992 | Bertucci et al. . | |
| 5,417,497 | 5/1995 | Rumler . | |
| 5,771,586 | 6/1998 | Lotarski et al. | 30/293 |

*Primary Examiner*—Rinaldi I. Rada
*Assistant Examiner*—Gyounghyun Bae
*Attorney, Agent, or Firm*—Coats & Bennett, P.L.L.C.

[57] ABSTRACT

An apparatus for variable length belt splitting includes a stepwise feeder which urges the belt, such as conveyor belt, forward in discrete steps and a reciprocating cutter disposed downstream from the feeder. The feeder preferably includes both a holding clamp and a feed clamp that is connected to, and is moved with respect to, the holding clamp by a feed actuator. The cutter preferably moves parallel to the holding clamp and is moved back and forth by a bi-directional ram. The cutter splits the belt edge to edge at a predetermined depth in length increments corresponding to the feeder's step length to a total length determined by the user. Optionally, the feeder and cutter are connected to a support structure which allows the feeder and cutter to be placed at an angle with respect to the path of the belt through the machine, thereby allowing for diagonal splits to be made with respect to the longitudinal axis of the belt without stewing of the belt. Advantageously, some embodiments of the present invention allow for the belt to be split while maintaining the integrity of the reinforcing layers and the adhesion thereof to the main belt layers. The belt splitter allows for the belt to be split up to any distance selected by the user. A method for splitting belts includes feeding the belt to a cutter in discrete steps having a step length and moving the cutter in a reciprocating manner after each step. The movement of the cutter against the belt splits the belt from one side to the other in length increments corresponding to the step length to an overall split length determined by the user. Optionally, the split is aligned diagonally with respect to the longitudinal axis of the belt. The method preferably splits the belt without damaging any bonds between main layers and reinforcing layers and without damaging the reinforcing layers.

21 Claims, 7 Drawing Sheets

BELT SPLITTING MACHINE

FIELD OF THE INVENTION

The present invention relates generally to belts, and more particularly to a belt splitting machine.

BACKGROUND OH THE INVENTION

Belts 4, and more particularly conveyor belts, are typically fabricated from multiple layers 8,6, as shown in FIG. 1. In most belts, the different main layers 6 of rubber or other plastic material are interleaved with reinforcing layers 8 of fabric or the like to form a laminate structure. Because it is desirable for the reinforcing layers 8 to be bonded to the main layers 6 very tightly to help promote maximum strength, the main layers 6 are bonded to the reinforcing layers 8 through special bonding processes typically tightly controlled by the belt's manufacturer. The belts 4 are typically manufactured in long strips which are spliced together in one or more locations to form a continuous loop. Due to the stresses imposed on the conveyor belts, it is important that the splice be as high a quality as possible so as to prevent, or at least delay, belt failure at the splice.

Over time, a number of methods have been employed to splice belt ends together. The simplest method is the butt splice where the opposing ends of the belt are cut and then bonded together, such as by glue or stapling. Such butt splices are weak. Stronger splices are achieved when there is some sort of overlapping of the two belt ends, such as when the top half of one end and the bottom half of the other end are removed and the complementary portions of the ends are overlapped and bonded together by gluing, etc., and thereafter vulcanizing with presses having heated platens. For some applications, it is desirable to form stepped splices having staggered overlapping levels, as shown in FIG. 1. In addition, the belt material of the complementary opposing ends may be formed into an interleaved finger arrangement. It is believed that strong joints are formed when complementary portions of a main layer 6 from of the opposing ends of the joint are bonded together without an intervening reinforcing layer 8, as shown in FIG. 1. Further, it is desirable for the reinforcing layers 8 of the respective ends to be both unseparated from their adjoining main layers 6 and undamaged. Whatever the splice arrangement, the opposing belt ends of the splice are typically cut so as to mirror each other.

In order to form overlapping splice joints, it is necessary to remove a portion of the belt material from the respective belt ends. Typically, this process is a manual process in which two of the layers are separated by stripping one from the other for some distance along the belt, then cutting off the material above or below the separation. This manual stripping process typically involves the use of cutting blades, pliers, buffing machines, and the like, and is time consuming. Due to the various levels of cohesion, adhesion, and localized stresses, this manual stripping almost invariably produces a rough surface having numerous pits and leftover tags of material, requiring subsequent buffing or sanding to create a smoother surface suitable for splicing. In addition, the manual process frequently damages the "skim layer", the portion of the main layer material closest to the reinforcing layer 8 which provides the adhesion between the main layer 6 and the reinforcing layer 8. Further, the manual process frequently damages the material of the reinforcing layer 8 itself.

Alternatively, belt splitting machines are available. A belt splitting machine is designed to split a layer of the belt (typically a main layer 6), rather than separating or stripping one layer from another. A typical example of an available belt splitting machine is the model Type 95 from Muller & Kurth Offenbach A. M. of Germany. This machine uses a pair of continuously driven pinch rollers to force the belt into stationary cutting blade. The cutting blade impinges upon the side of the belt at a given vertical height and splits the belt from one side to the other as the belt is fed into it. Due to the mechanics involved, the machine is rather cumbersome and can only be used to split the belt up to a rather limited length, such as five inches. The machine is unsuited to making multiple staggered splits at different levels of the same belt end.

In light of the above, there remains a need for a belt splitter which can split a belt for a variable length as the user demands and that can split the belt without damaging the reinforcing layers. It is desirable, but not required, for such a machine to be able to split the belt both square, i.e. perpendicular with respect to the belt length, and on a bias, i.e. diagonally with respect to the belt length. It is further desirable, but not required, for such a belt splitter to be suitable for making staggered length splits at different depths of the same belt end.

SUMMARY OF THE INVENTION

The present invention provides an apparatus and method for variable length belt splitting. The apparatus includes a stepwise feeder which urges the belt forward in discrete steps and a reciprocating cutter disposed downstream from the feeder. The feeder preferably includes both a holding clamp and a movable feed clamp connected to the holding clamp by a feed actuator. The cutter preferably moves parallel to the holding clamp and is moved back and forth by a bi-directional ram. The cutter horizontally splits the belt from one side to the other side (edge to edge, not top to bottom) at a user determined depth in length increments corresponding to the feeder's step length to a total length determined by the user. Optionally, the feeder and cutter are connected to a support structure which allows the feeder and cutter to be placed at an angle with respect to the path of the belt through the machine, thereby allowing for diagonal splits to be made with respect to the longitudinal axis of the belt. Because the feed clamp is limited to move in a direction perpendicular to the holding clamp, the belt should not slew sideways when diagonal splits are made. Advantageously, some embodiments of the present invention allow for the belt to be split at a location away from the "skim layer," thereby maintaining the integrity of the reinforcing layers and the adhesion thereof to the main layers. Unlike prior art belt splitters, the present invention allows for the belt to be split up to any distance selected by the user.

The method of the present invention includes feeding the belt to the cutter in discrete steps having a step length and moving the cutter in a reciprocating manner after each step. The movement of the cutter against the belt splits the belt from one side to the other in length increments corresponding to the step length up to a variable overall split length determined by the user. Optionally, the split is aligned diagonally with respect to the longitudinal axis of the belt. The method preferably splits the belt without damaging any bonds between main layers and reinforcing layers and without damaging the reinforcing layers.

DETAILED DESCRIPTION

Figure 1:
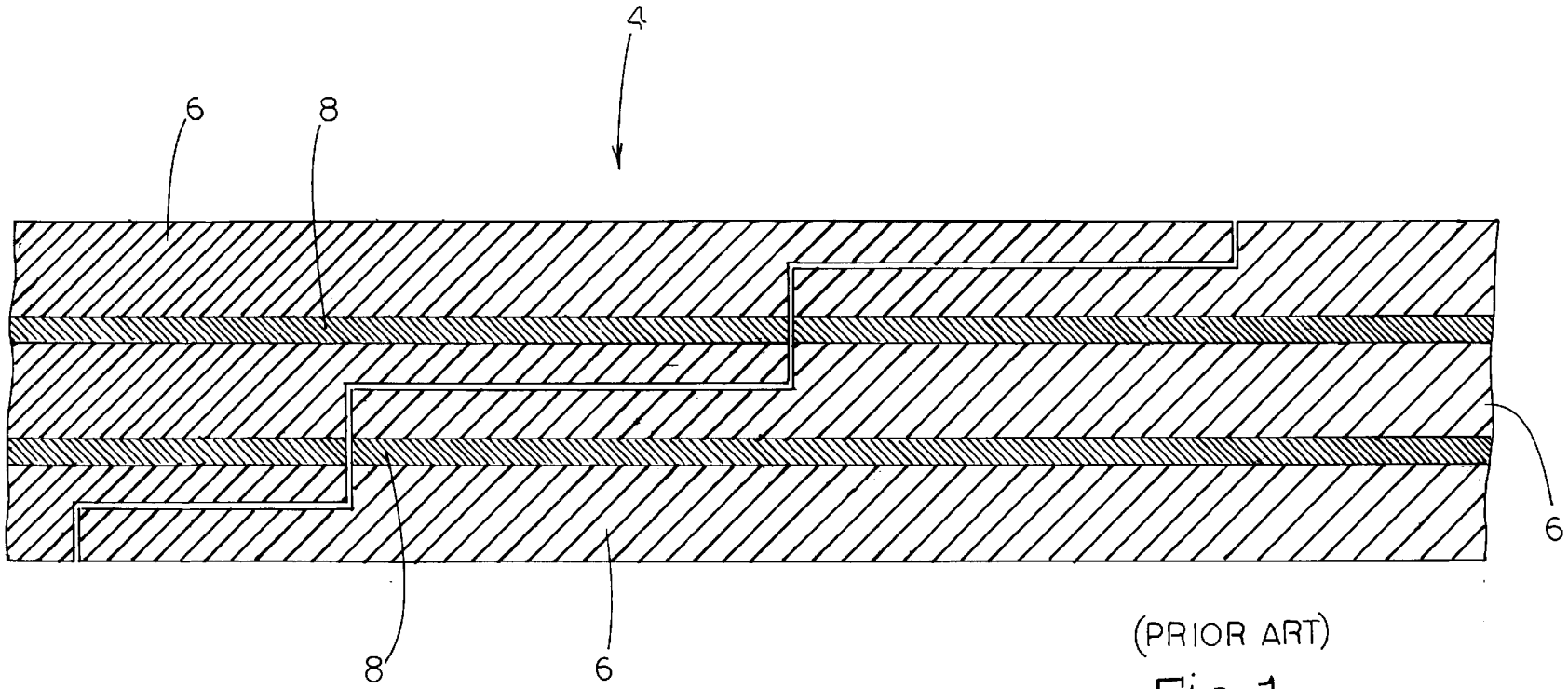
(PRIOR ART) FIG. 1
FIG. 1 is a partial sectional view of a staggered overlapping splice joining two belt ends showing multiple layers.

For purposes of illustration, a three main, five total, layer conveyor belt 4 as shown in FIG. 1 will be used for discussion, but the present invention is not limited to such five layer belts 4. Instead, the invention is useful for the entire range of single or multi-layer flexible belts 4, made from rubber, plastic, or the like, with and without reinforcing layers 8. Such belts may be typically used, for instance, for conveyor belts or power transmission belts, but other belt applications are possible.

Figure 2:
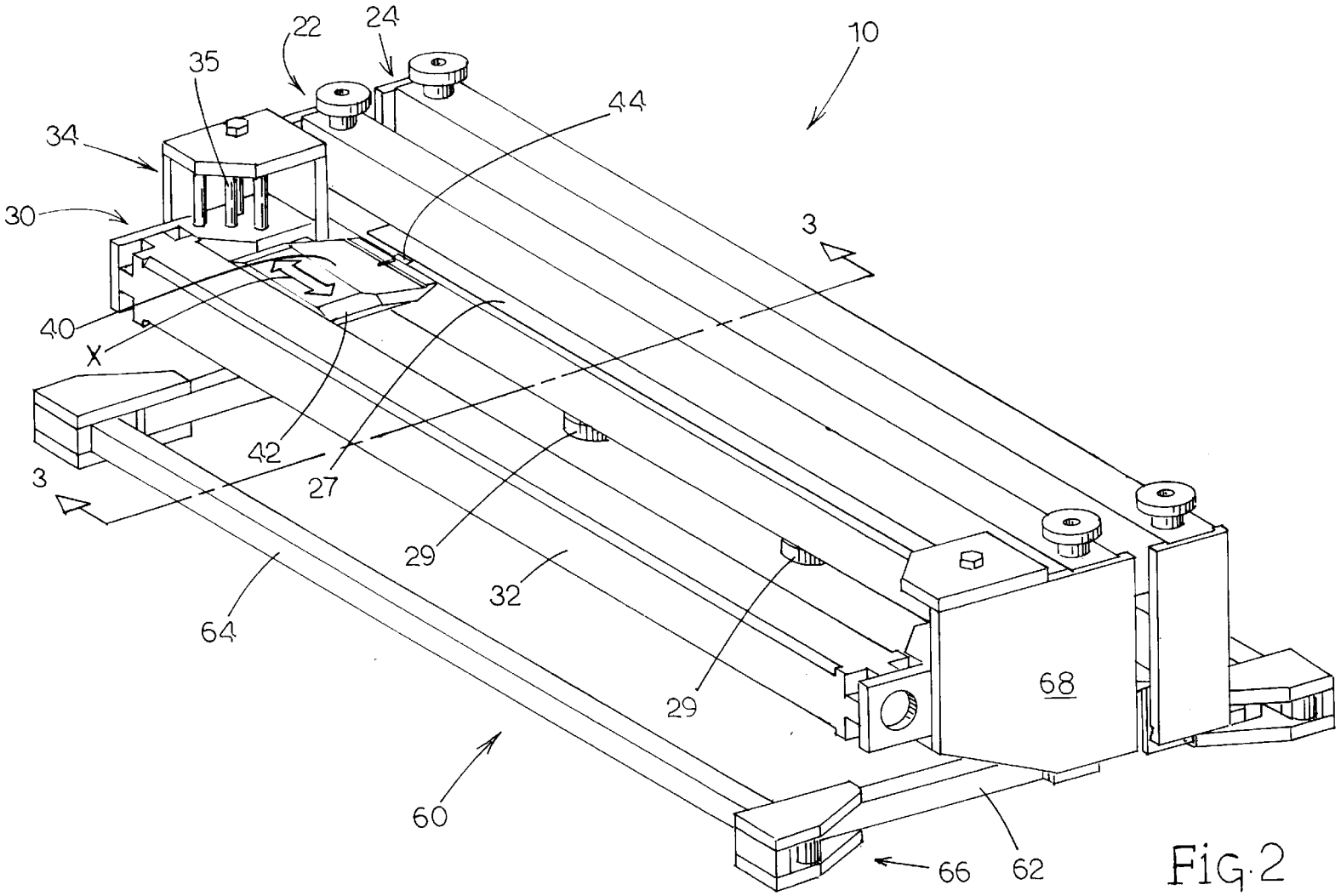
FIG. 2 is a perspective view of one embodiment of a belt splitter of the present invention with the shield removed.
Figure 3:
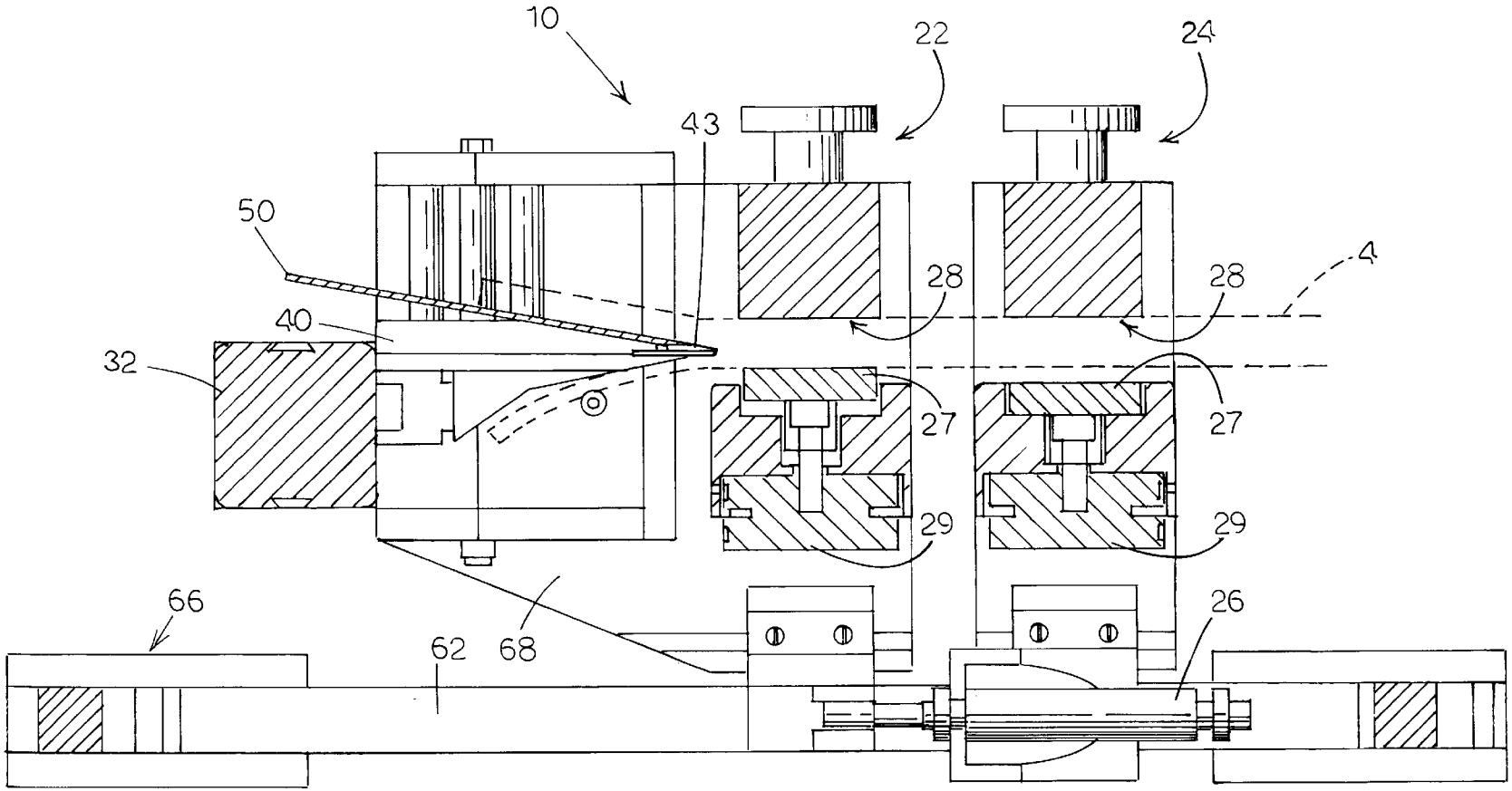
FIG. 3 is a partial sectional side view of the belt splitter of FIG. 2 along the line 3—3 with the shield added and with a belt shown in phantom lines.

One embodiment of the belt splitter 10 of the present invention is shown in FIG. 2 and FIG. 3. The belt splitter 10 therein includes a feeding assembly 20, a cutting assembly 30, a shield 50, a support structure 60, and a control system 100.

The feeding assembly 20 includes a pair of spaced apart clamps 22,24. One of the clamps, called the hold clamp 22, is stationary. The other clamp, called the feed clamp 24, is movable between at least two positions that are varying distances from the hold clamp 22. Between the two clamps 22,24 is a feed actuator 26 for changing the relative distance between the two clamps 22,24, such as a pair of pneumatic cylinders, one disposed at each end of the clamps. The holding clamp 22 and the feed clamp 24 are preferably in parallel alignment and attached to the support structure's 60 side rails 62, as discussed below. Both of the clamps 22,24 open and close under direction of the control system 100, such as by the use of pneumatic clamp actuators 29. Preferably, each clamp 22,24 includes a floating clamping bar 27 connected to the respective pneumatic clamp actuators 29. The floating clamping bars 27 move vertically so as to directly contact the belt 4 and clamp the belt 4 against a suitably rigid anvil surface 28 of the clamp 22,24. In FIG. 3, the anvil surface 28 of the clamps 22,24 are shown as the lower side of a box-shaped metal bar, but any substantially rigid anvil surfaces 28 would suffice, including an opposing clamping bar 27 likewise actuated by additional clamp actuators 29.

Because the throw, or actuation distance, of actuators is typically limited, there may be need for some vertical adjustment of the spacing between the clamping bars 27 and the respective anvil surfaces 28 to accommodate the wide variety of thicknesses for belts 4. For instance, the clamping actuators 29 may have a throw of D, while the range of belt thickness may be from 0.5D to 10D or more. In such a situation, additional adjustments for the (closed) spacing between the clamping bars 27 and the respective anvil surfaces 28 will be needed. While not shown in detail in the Figures, any one of a variety of mechanisms, well known in the art, would be suitable for this clamp height adjustment, such as a pair of adjustment screws at each end of the clamps 22,24 driven independently or coupled via a cranked bevel gear.

Figure 4:
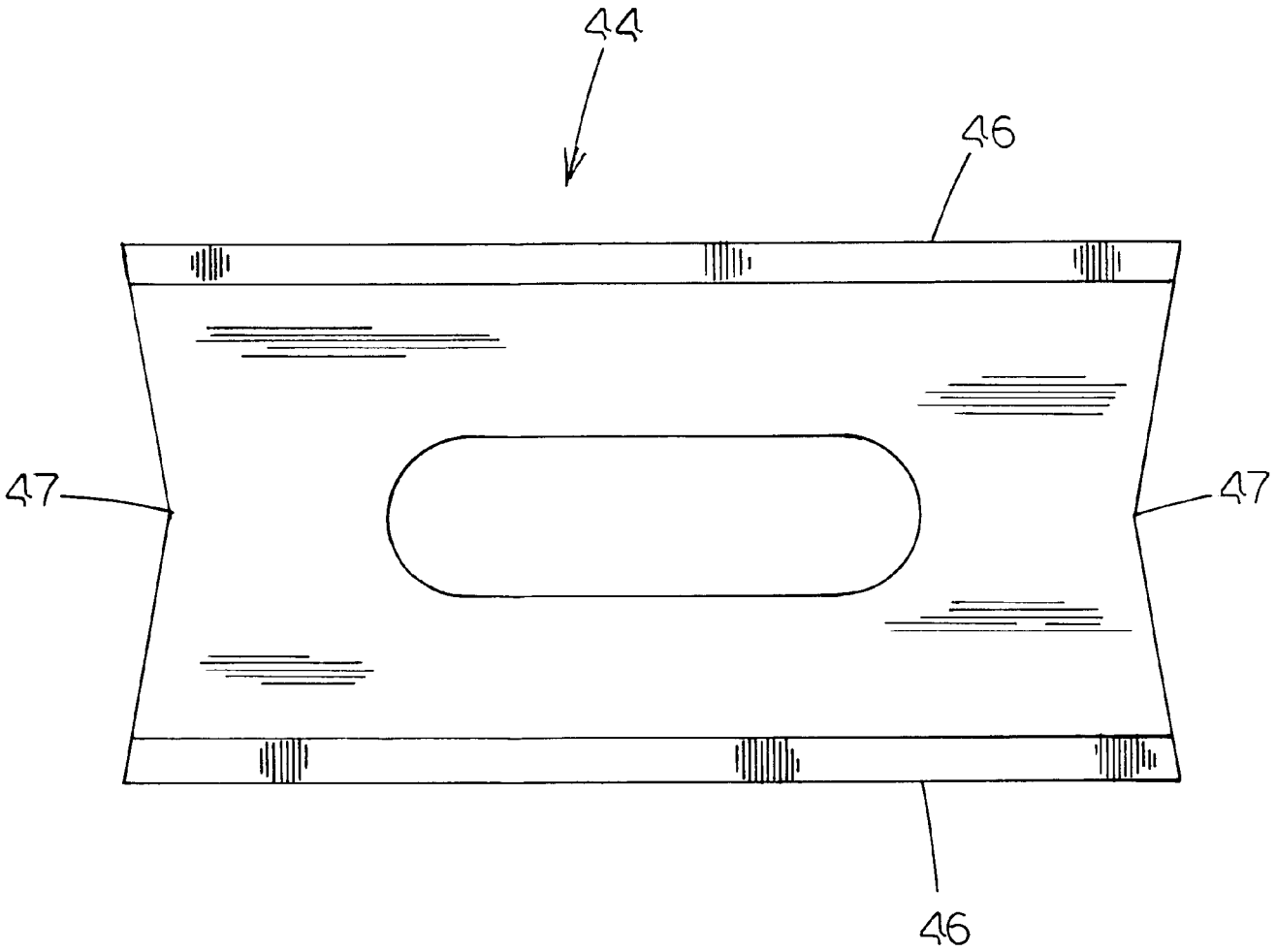
FIG. 4 is a top view of a cutting blade suitable for use with one embodiment of the present invention.

The cutting assembly 30 includes a horizontally moveable cutting head 40, a reciprocating driver 32 to move the cutting head 40, and an adjustment mechanism 34. The cutting head 40 is generally wedge shaped, with the smaller side pointing towards the feeding assembly 20. Preferably, the sides 42 of the cutting head 40 are also wedge shaped. Protruding from the front face 43 of the cutting head 40 is the cutting blade 44. The cutting blade 44 is preferably reversible as shown in FIG. 4, and has sharp cutting surfaces 46 on both sides. Further, the cutting blade 44 is preferably notched 47 along its front and back edges so that the points closest to the feeding assembly 20 are at the sides along the cutting surfaces 46. The distance that the cutting blade 44 protrudes from the cutting head 40 is preferably adjustable such as through a slot and set screw arrangement. The cutting head 40 is firmly mounted to the reciprocating driver 32. For the embodiment shown in FIG. 2, the driver 32 is a bi-directional pneumatic ram, but any means known in the art for moving the cutting head 40 back and forth (in the "x" direction as indicated in FIG. 2) would be suitable, such as by a stepper motor, chain drive, belt drive, or similar means. The cutting assembly 30 should be positioned such that the cutting blade 44 is very close to the holding clamp 22 of the feeding assembly 20. Further, an adjustment mechanism 34 should be provided for altering the vertical position of the cutting head 40. Any one of a variety of adjustment mechanisms 34, well known in the art, would be suitable, such as a pair of adjustment screws 35 at each end of the driver 32 driven independently or coupled via a cranked bevel gear. It should be noted that it is preferred that the path of the cutting head 40 be level.

Because the cutting blade 44 is sharp and may injure an inattentive user, it is desirable that a shield 50 be placed over the area where the cutting head 40 moves back and forth. This shield 50, if placed or shaped at a slight vertical angle, may also function as a guide for directing the top portion of the split belt 4 as described below.

A support structure 60 supports the feeding assembly 20, the cutting assembly 30, and the shield 50. The support structure 60 should maintain the path of the cutting head 40, the holding clamp 22, and the feed clamp 24 all in parallel alignment. Further, the support structure 60 should preferably allow for the belt 4 to be fed in at an angle so as to allow diagonal splits for diagonal splices. Therefore, it is preferred that the support structure 60 include a pair of stiff side rails 62 pivotally joined to a pair of stiff end rails 64. With pivotable joints 66 at each corner, the support structure 60 could be formed into any parallelogram shape, including a rectangle. The pivotable joints 66 should be lockable, such as by a pin and locking hole arrangement. One approach for maintaining the proper alignment of the cutting head 40, the holding clamp 22, and the feed clamp 24 is through the use of linear bearings (disposed to slide along the side rails 62) to interconnect these parts with the side rails 62 of the support structure 60.

Figure 5A:
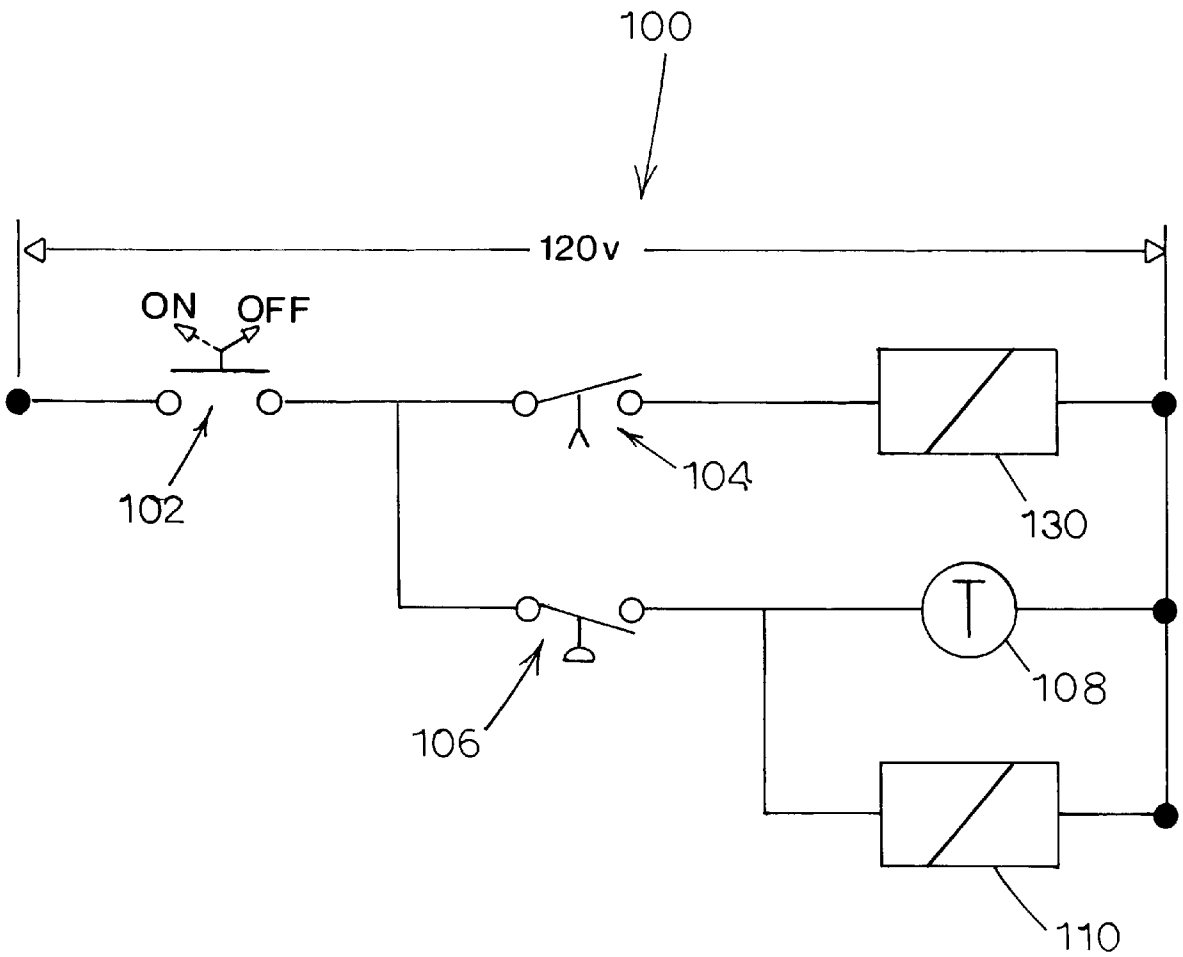
FIGURE 5A is an electrical schematic of a portion of a control system.
Figure 5B:
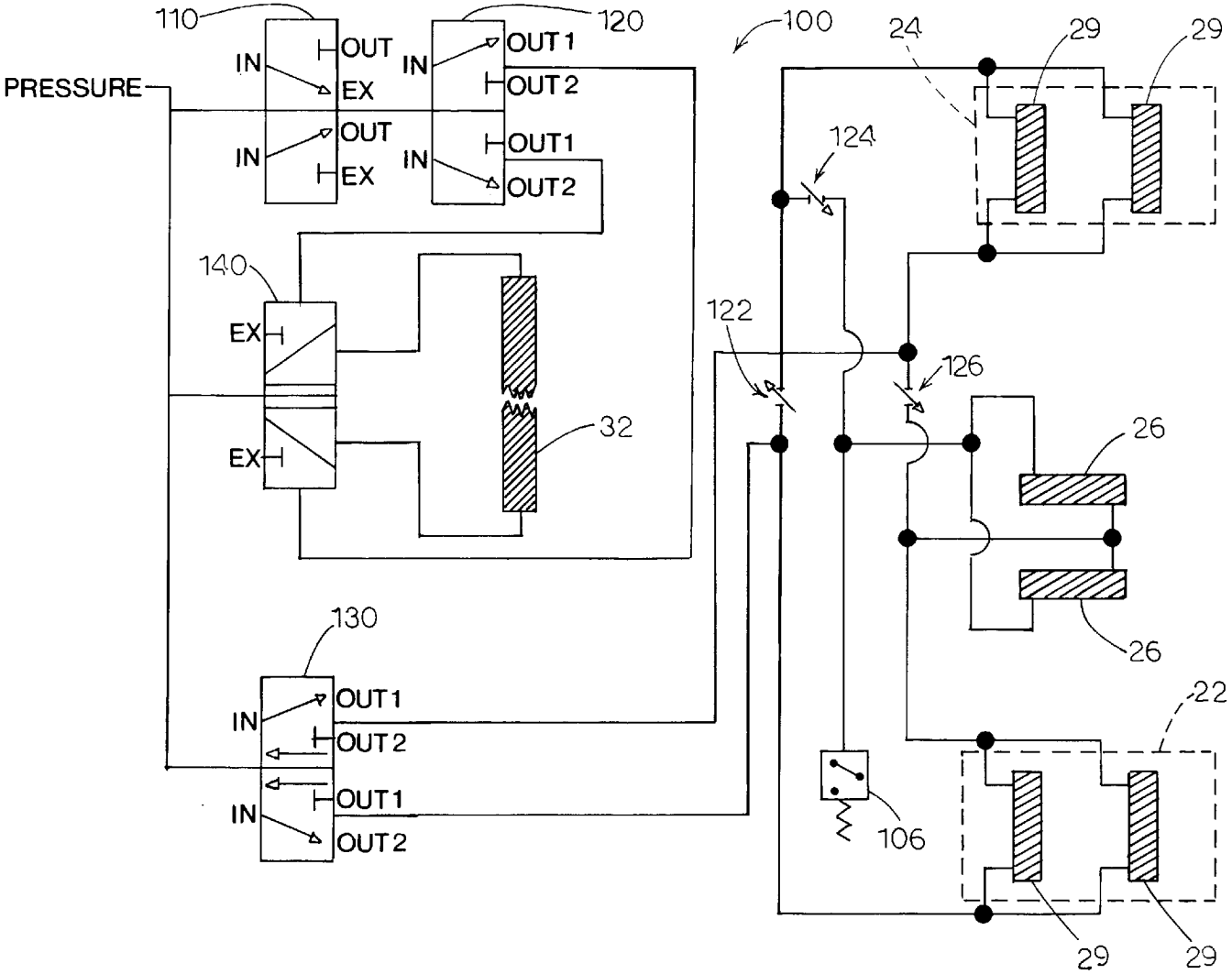
FIG. 5B is an pneumatic schematic of a portion of a control system.

The control system 100 controls the overall operation of the belt splitter 10 and may be mounted to the support structure 60 or be free standing. As described above, the feeding assembly 20 and the cutting assembly 30 contain moving parts. The timing and sequence of the movements of the parts are controlled by the control system 100. An example of a suitable control system 100 is shown in FIGS. 5A and 5B. The control system 100 of FIGS. 5A and 5B includes both electrical and pneumatic components. The electrical portion, shown in FIG. 5A, includes an on/off switch 102 connected to a timer controlled switch 104 and a normally open pressure switch 106. The timer controlled switch 104 is normally closed, but opened on expiration of a timer 108 and controls the energizing of air solenoid B 130. The pressure switch 106 controls the energizing of air solenoid A 110 and the timer 108. When the on/off switch 102 is initially closed, air solenoid B 130 is energized and the timer 108 and air solenoid A 110 are de-energized. When air solenoid B 130 is energized, pressure should be routed to the pressure switch 106, eventually causing the pressure switch 106 to close. When pressure switch 106 is closed, the timer 108 and air solenoid A 1 10 are energized. When the timer 108 expires, the timer controlled switch 104 opens, de-energizing air solenoid B 130, which eventually alleviates the air pressure build-up monitored by the pressure switch 106, closing the pressure switch 106, turning off the timer 108 and de-energizing air solenoid A 110.

The pneumatic portion of the control system 100 is shown in FIG. 5B. Pressurized air is supplied to air solenoid A 110, air solenoid B 130, and a pressure valve 140. Air solenoid A 110 alternately causes the driver 32 to move the cutting head 40 one direction and the other via the binary valve 120 and the pressure valve 140. When energized, air solenoid A 110 provides air to the binary valve 120; when de-energized, air solenoid A 110 exhausts. The binary valve 120 alternately routes pressurized air to the one side or the other of the pressure valve 140, switching states in response to pressurized air being supplied by air solenoid A 110. The pressure valve 140 in turn alternately routes pressurized air to one side or the other of the driver 32 as shown in FIG. 5B. Air solenoid B 130 controls the flow of pressurized air to the actuators 29 of the holding clamp 22, the feed clamp 24, and the feed actuators 26 as shown in FIG. 5B. Each clamp actuator 29 is provided with two input ports and two output ports and the feed actuators 26 are provided with two input ports and one output port. The various actuators 29,26 are interconnected as shown in FIG. 5B. In FIG. 5B, filling the lower portion of the actuators 29,26 causes the corresponding actuators 29,26 to extend, while filling the upper portion causes the corresponding actuators 29,26 to retract. Only one actuator 29 is shown for the holding clamp 22; however, preferably there are at least two actuators 29 for the holding clamp 22 connected in parallel. Likewise for the feed clamp 24 and the feed actuator 26. The pneumatic portion of the control system 100 is shown in FIG. 5B works with the electrical portion of the control system 100 shown in FIG. 5A.

The timing and sequence of the movements of the actuators 26,29 and the driver 32, will depend on the relative fill rates of the actuators 26,29, the time period of the timer 108, and the pressure trigger level of the pressure switch 106, but should be along the lines described below. To help achieve the proper control sequence, it may be desirable to include adjustable restrictors in the pneumatic lines interconnecting air solenoid B 130 and the clamp/feed actuators 26,29 to allow easy adjustments to the timing.

The feeding assembly 20 feeds the belt end to be split to the cutting assembly 30 in a stepwise fashion. With the cutting blade 44 to the side and not in contact with the belt 4, the holding clamp 22 closed, and the feed clamp 24 open, the driver 32 is activated to move the cutting head 40 from one side to the other. Thereafter, the feed clamp 24 is closed, the holding clamp 22 opens, and the feed clamp 24 is moved toward the holding clamp 22 by the feed actuator 26. This action advances the belt 4 in a discrete stepwise manner; the amount of the advancement is the step length of the discrete step and should correspond to the throw, or actuation distance, of the feed actuator 26. The holding clamp 22 then closes, thereby gripping the belt 4 and holding it in position. The feed clamp 24 is then opened and the feed actuator 26 moves the feed clamp 24 back away from the hold clamp 22 (see FIG. 3). With the hold clamp 22 closed, the driver 32 is activated to move the cutting head 40 from one side to the other. In so doing, the cutting blade 44 is brought into contact with the belt 4 and splits the belt 4 an incremental amount. Preferably, the cutting blade 44 is protruding from the cutting head 40 a little more than the distance than the actuation distance of the feed actuator 26. That is, the cutting blade 44 should extend out from the cutting head 40 at least the same amount as the incremental belt movement. The lower portion of the split belt 4 droops away from the cutting head 40 while the upper portion of the split belt 4 flows up onto the shield 50 (see FIG. 3). When the cutting head 40 reaches the far point of its travel, the cycle begins again. The feed clamp 24 closes, the holding clamp 22 opens, the feed clamp 24 moves towards the holding clamp 22 under the urging of the feed actuators 26, the holding clamp 22 closes, the feed clamp 24 opens, the feed clamp 24 moves back under the urging of the feed actuators 26, and the cutting head 40 makes another pass (this time in the opposite direction). The cycle continues until the desired split length is reached. In such a manner, the length of the split may be any amount that the user desires, up to the entire length of the belt.

For single layer belts, the vertical level cutting blade 44 should be set to the middle of the belt 4 via the adjustment mechanism 34. For multiple layer belts, the vertical level of the cutting blade 44 should be set to the middle of one of the main layers 6. If a stepped splice is desired, then a subsequent split of a different length may be made through a different layer. The opposing mirror image end of the splice is prepared in a similar manner.

In most cases, a diagonal split will be desired. In such instances, the belt splitter 10 should be configured into a non-rectangular parallelogram by using the pivotable joints 66. The side rails 62 should be aligned with the path of the belt 4 and the holding clamp 22 aligned with the desired angle of the diagonal split. Because the feed clamp 24 moves along the side rails 62, the feed clamp 24 will be moving, and thereby urging the belt 4 to move, directly along the belt's 4 path, thereby avoiding slewing of the belt 4 from one side to the other of the belt splitter 10.

For belt splitters 10 that will produce numerous diagonal splits, it may be desirable to add a selectively engageable initial cutter (not shown) to the cutting head 40 that would be disposed normal to the cutting surface 46 of the cutting blade 44. Alternatively, the initial cutter could be plug compatible with the cutting head 40. This initial cutter could be manually engaged for the first stroke of the cutting head 40 (or initial cutter) and then disengaged. The purpose of such an initial cutter would be to smoothly cut through the belt 4 from top to bottom at the same angle that the cutting blade 44 will be splitting the belt 4.

A belt splitter 10 described above is suitable for splitting ends of belts 4 to any desired length. Further, due to the feeding approach used, even non-uniform thickness belts 4 can be split without undue slewing.

If the thin sharp cutting blade 44 described above is used, the belt splitter 10 can split the ends of belts 4 without the removal of a significant portion of the belt 4 material. That is, the belt ends may be "split" without removing significant layer material such as what would occur with a laterally moving saw blade or if buffing is required.

The holding clamp 22 above was described as stationary; however the holding clamp 22 may have adjustable positioning. For instance, the holding clamp 22 may be adjustable to various locations on the side rails 62 by the user and then secured in place for operation. Obviously, because the holding clamp 22 and the feed clamp 24 are interconnected by the feed actuator 26, the feed clamp 24 will likewise need to be repositioned when the holding clamp 22 is repositioned. Alternatively, both the holding clamp 22 and the feed clamp 24 may be floating on the support structure 60, provided that they are maintained substantially parallel to one another and their movement is constrained to be perpendicular thereto. The cutting assembly 30 should preferably be in a fixed relationship to the holding clamp 22, such as by being mounted to a common frame element 68.

The holding clamp 22 and feed clamp 24 are shown as having the clamp actuators 29 and floating clamping bars 27 on the lower portion thereof and the clamp anvil surfaces 28 on an upper portion thereof. However, such orientation is not required and an alternative equivalent arrangement would be to in essence flip over the holding clamp 22 and feed clamp 24 such that the 29 actuators are on an upper portion thereof and push downward to clamp. In such a flipped orientation, the floating clamping bars 27 may not be required for all types of belts 4.

The belt splitter 10 described above used a moving feed clamp 24 and a stationary holding clamp 22. It is possible that the feed clamp 24 could be eliminated and the holding clamp 22 be made to reciprocate; while such an approach is within the present invention, it is not believed to produce consistently satisfactory results.

The control system 100 described is based on a combined electrical/pneumatic control system 100. However, the pneumatic portion of the control system 100 may equivalently be replaced with hydraulic or electrical switches, relays, actuators, and the like.

Figure 6:
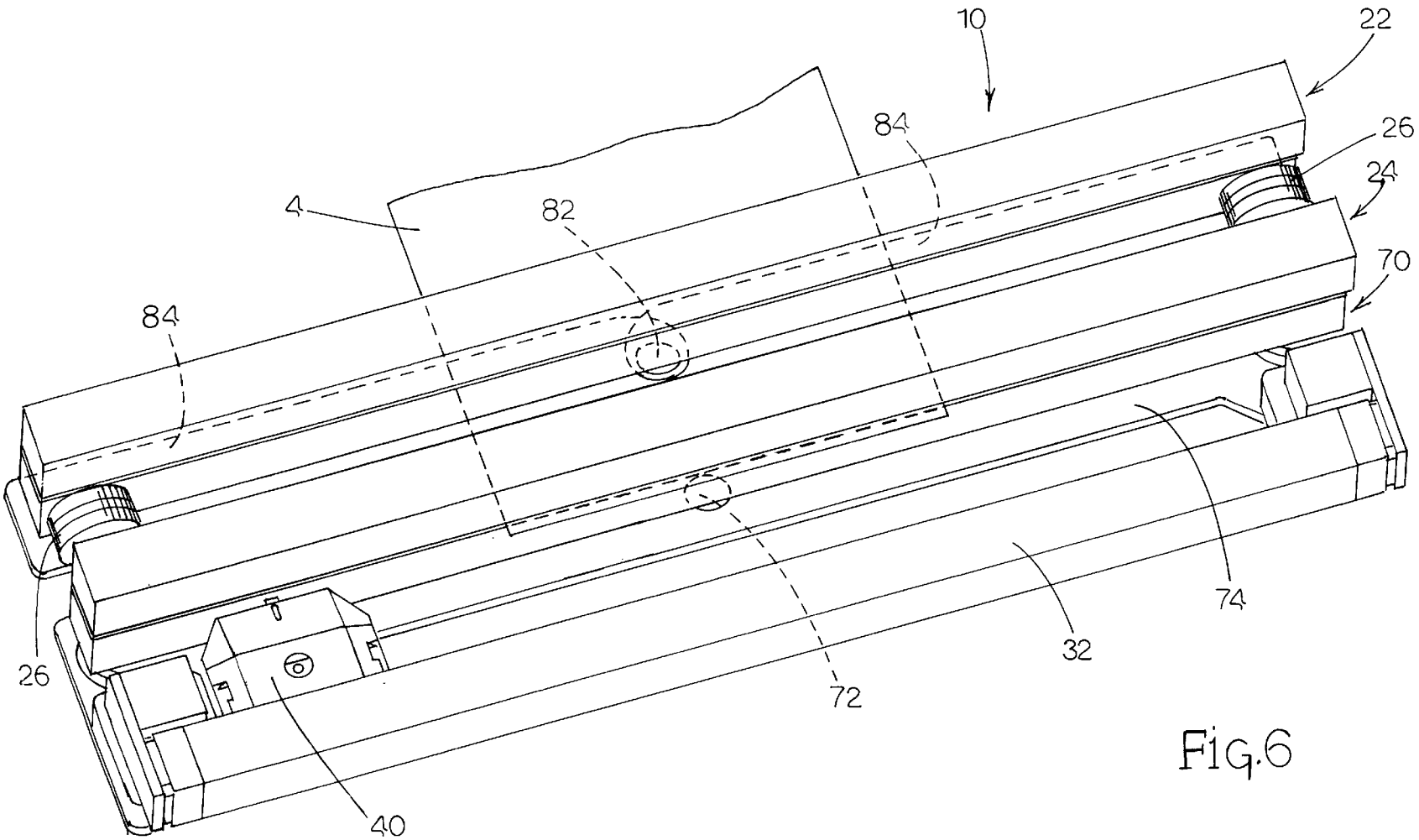
FIG. 6 is a perspective view of another embodiment of a belt splitter of the present invention with a belt shown in phantom lines.

An alternative embodiment of the belt splitter 10 is shown in FIG. 6. In this embodiment, the angular orientation of the belt splitter 10 (to accommodate diagonal splits) is achieved by having the holding clamp 22 pivot about one point 72, while the feed clamp 24 pivots about another point 82. The holding clamp 22 and cutting assembly 30 are rigidly interconnected such that the cutting head 40 and the holding clamp 22 are kept a uniform distance apart. This may be accomplished by securing the holding clamp 22 and cutting assembly 30 to a generally U-shaped base plate 74, with the holding clamp 22 extending along the base of the U and the cutting assembly 30 spanning the legs of the U The combined holding clamp and cutting assembly 70 pivot about a first point 72 centrally located along the holding clamp 22, such as by pivoting the U-shaped base plate 74 about a point midway along its base as shown in FIG. 6. The feed clamp 24 is interconnected to the holding clamp 22 by the feed actuators 26 as in the embodiments discussed above. However, instead of being coupled to the side rails 62 as shown in FIG. 2, the feed clamp 24 is coupled near its ends to a pair of movable arms 84 which each pivot about a common second point 82 which is centrally located with respect to the feed clamp 24 in its away position. This second point 82 is offset from the first point 72 a fixed distance in a direction perpendicular from the path of the cutting head 40. When the feed clamp 24 is moved toward the hold clamp 22 by the feed actuators 26, the movable arms 84 rotate about the second pivot point 82 and the feed clamp 24 moves toward the holding clamp 22 in a parallel alignment therewith. Suitable means, such as slots, are provided to allow the lateral displacement of the interconnection between the feed clamp 24 and the movable arms 84 so as to accommodate this parallel movement of the feed clamp 24 without distorting the feed clamp 24 due to the changing arc length of the angle between the two movable arms 84. By using this arrangement, the support structure 60 may be reduced from the pivotable side rail 62 and end rail 64 embodiment shown in FIG. 2 to the more compact support structure 60 of FIG. 6, thereby reducing the space required for operation.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A splitter for belts having a top, bottom and sides, comprising:

a) a stepwise feeder, said feeder urging said belt forward in discrete steps having a step length;

b) a reciprocating cutter disposed downstream from said feeder;

c) wherein said cutter splits the belt from one side to the other side in length increments corresponding to said step length to a total length determined by the user; and d) a support structure connected to said feeder; said support structure including a first pair of stiff rails and a second pair of stiff rails interconnected by a plurality of pivotable joints so as to form a parallelogram; wherein said first pair of rails are parallel to the path of the belt and wherein said first pair of rails constrains said feeder to move parallel to the path of the belt.

2. The splitter of claim 1 wherein said feeder includes a pair of pinch rollers.

3. The splitter of claim 1 wherein said feeder includes a hold clamp and a movable feed clamp.

4. The splitter of claim 3 wherein said hold clamp is parallel to the path of said cutter and wherein said feed clamp moves relative to said hold clamp so as to urge said belt forward in said discrete steps.

5. The splitter of claim 3 wherein said hold clamp is disposed diagonally with respect to the path of said belt and said cutter moved parallel to said hold clamp while reciprocating.

6. The splitter of claim 1 wherein said cutter includes a cutting blade having a smooth cutting surface.

7. The splitter of claim 6 wherein said belt includes at least two layers joined together by a bond and wherein said cutting blade splits a portion of the belt without damaging said bond when said cutter reciprocates.

8. The splitter of claim 1 wherein said parallelogram formed by said rails is non-rectangular.

9. A splitter for belts having a top, bottom and sides, comprising:

a) a stepwise feeder, said feeder including a hold clamp and a movable feed clamp urging said belt forward in discrete steps having a step length;

b) a reciprocating cutter disposed downstream from said feeder;

c) wherein said cutter splits the belt from one side to the other side in length increments corresponding to said step length to a total length determined by the user; and d) a base plate connected to said hold clamp and a pair of movable arms connected to said feed clamp; wherein said base plate pivots about a first point; wherein said movable arms pivot about a second point.

10. The splitter of claim 9 wherein said first point and said second point are in a fixed relationship to one another.

11. A splitter for belts, said belts having a longitudinal axis and at least two layers joined together by a bond, comprising:

a) a stepwise feeder having a stationary holding clamp and a movable feed clamp interconnected by a feed actuator; said feed actuator operable to move said feed clamp toward said holding clamp; said holding clamp operable between an open state and a closed state; said feed clamp operable between an open state and a closed state; said feeder urging said belt forward in discrete steps having a step length;

b) a reciprocating cutter disposed downstream from said holding clamp, said cutter including a cutting blade having a smooth cutting surface; and d) wherein said cutter splits the belt horizontally in length increments corresponding to said step length to a total length determined by the user, without damaging said bond when said cutter reciprocates.

12. The splitter of claim 11 further including a support structure connected to said feeder; said support structure including a first pair of stiff rails and a second pair of stiff rails interconnected by a plurality of pivotable joints so as to form a parallelogram; wherein said first pair of rails are parallel to the path of the belt and wherein said first pair of rails constrains said feeder to move parallel to the path of the belt.

13. The splitter of claim 12 wherein said parallelogram formed by said rails is non-rectangular and wherein said the split formed by said cutter is diagonal with respect to the longitudinal axis of the belt.

14. The splitter of claim 11 further including a base plate connected to said hold clamp and a pair of movable arms connected to said feed clamp; wherein said base plate pivots about a first point; wherein said movable arms pivot about a second point; and wherein said first point and said second point are in a fixed relationship to one another.

15. The splitter of claim 14 wherein the split formed by said cutter is diagonal with respect to the longitudinal axis of the belt.

16. A splitter for conveyor belts, said belts having a top, a bottom, sides, and a longitudinal axis, comprising:

a) a support structure;

b) a stepwise feeder attached to said support structure and having a stationary holding clamp and a movable feed clamp interconnected by a feed actuator; said feed actuator operable to move said feed clamp toward said holding clamp; said holding clamp operable between an open state and a closed state; said feed clamp operable between an open state and a closed state and movable relative to said holding clamp by said feed actuator; said feeder urging said belt forward in discrete steps having a step length, said holding clamp having a main axis non-parallel to the longitudinal axis of said belts;

c) a reciprocating cutter connected to said support structure and disposed downstream from said feeder; said cutter including a cutting blade having at least one smooth cutting surface;

d) a bi-directional ram connected to said cutter; said ram intermittently moving said cutter parallel to said main axis of said holding clamp;

e) wherein said cutting blade splits the belt horizontally from one side to the other side in length increments corresponding to said step length to a total length determined by the user; and f) wherein said belt includes at least two layers joined together by a bond and wherein said cutter forms said split in said belt without damaging said bond.

17. The splitter of claim 16 wherein said split is diagonal with respect to the longitudinal axis of said belt.

18. A method for splitting a conveyor belt having an end, sides and a longitudinal axis, comprising:

a) feeding, by a stepwise feeder, the belt forward in discrete steps having a step length;

b) moving a cutter disposed downstream from said feeder after each of said steps; said moving being in opposing directions for alternating steps; and c) forming, by said cutter, a split in said belt end from one side to the other side in length increments corresponding to said step length to a total length determined by the user.

19. The method of claim 18 wherein said split is diagonal with respect to the longitudinal axis of the belt.

20. The method of claim 18 wherein said feeder includes a hold clamp and a movable feed clamp and wherein said hold clamp is parallel to the path of said cutter and wherein said feed clamp moves relative to said hold clamp so as to urge said belt forward in said discrete steps.

21. The method of claim 18 wherein said conveyor belt includes at least two layers joined together by a bond and wherein said cutter forms said split without damaging said bond.

* * * * *